US007565851B2

(12) United States Patent
Louesdon et al.

(10) Patent No.: US 7,565,851 B2
(45) Date of Patent: Jul. 28, 2009

(54) GEOMETRICAL CONSTRUCTION PROCESS FOR A FLASH LAND FOR THE FORGING OF A COMPLEX PART

(75) Inventors: Yvon Louesdon, Taverny (FR); Jean-Claude Plazanet, Argenteuil (FR)

(73) Assignee: SNECMA, Paris (FR)

( * ) Notice: Subject to any disclaimer, the term of this patent is extended or adjusted under 35 U.S.C. 154(b) by 904 days.

(21) Appl. No.: 11/176,318

(22) Filed: Jul. 8, 2005

(65) Prior Publication Data

US 2006/0005386 A1 Jan. 12, 2006

(30) Foreign Application Priority Data

Jul. 9, 2004 (FR) ..... 04 51497

(51) Int. Cl.
*B21J 13/02* (2006.01)
*B21K 5/20* (2006.01)

(52) U.S. Cl. ..... 76/107.1; 29/889.7; 29/407.05; 700/189; 702/167

(58) Field of Classification Search ..... 29/889.7, 29/33 A, 526.2, DIG. 18, 407.01, 407.05; 76/107.1
See application file for complete search history.

(56) References Cited

U.S. PATENT DOCUMENTS 1,932,426 A * 10/1933 Stevens ..... 72/38
2,503,630 A * 4/1950 Norton ..... 76/107.1
2,987,806 A 6/1961 Pekarek
5,187,967 A 2/1993 Singh et al.
5,288,209 A * 2/1994 Therrien et al. ..... 416/193 R
7,433,799 B2 * 10/2008 Lin et al. ..... 702/167

FOREIGN PATENT DOCUMENTS

GB 584623 1/1947

* cited by examiner

*Primary Examiner*—David P Bryant
*Assistant Examiner*—Sarang Afzali
(74) *Attorney, Agent, or Firm*—Oblon, Spivak, McClelland, Maier & Neustadt, P.C.

(57) ABSTRACT

A process for geometrical construction of a flash land is provided for a flash land that is to be provided in a die for forging of a turbomachine vane, in accordance with determined parameters, where the vane includes a blade. The process includes choosing at least three reference planes corresponding to a root, middle and tip of the blade. At least three reference sections of the blade in reference planes corresponding to the root, middle and tip of the blade are chosen in the reference planes. A length of the flash land and a shrinkage distance for the three reference sections are determined in the reference planes. Intermediate sections of the flash land and the corresponding flash gutter of the flash land from the reference sections are constructed by interpolation in the predetermined planes.

5 Claims, 4 Drawing Sheets

GEOMETRICAL CONSTRUCTION PROCESS FOR A FLASH LAND FOR THE FORGING OF A COMPLEX PART

This present invention concerns the geometrical construction of the impressions of forging dies and more precisely of the flash lands and their gutters placed on the periphery of the impressions for the forging of complex parts, in this case the vanes of turbomachines.

The flash land is the means by which one ensures the filling of the impression by the material during the forging of the parts. By creating an appropriate flash land, one ensures that the trapped material is forced to fill the cavity of the impression first, before escaping beyond it. The flash land allows the removal of the surplus of material at the exit from the impression.

Apart from the correct flow of the material, optimising the shape of the flash land results in good repeatability of the parts obtained and a reduction of the forging forces, leading to an increase in the life expectancy of the stamping tools.

This optimisation depends in particular on the temperature of the part and of the tools, their mutual coefficient of friction, and the shape of the blank of the part before the forging process.

To determine the geometry of the flash land, one uses in particular the specification for the shape of the forged part. For complex parts such as the vanes of turbomachines, it is necessary to define the characteristics of the transverse sections of the blade, in the thickness direction, and of the flash lands to connect them by extension of the transverse sections of the blade from the above physical characteristics.

For the design of tools for the forging of turbomachine vanes, the calculations are demanding (thousands of points to be determined for the construction of a die) and as a consequence the process is costly. Moreover, the risk of entry errors is high and can lead to the appearance of parasitic corrugations in the surfaces defining the flash lands.

The applicant has sought to improve this process.

To this end, the invention concerns a geometrical construction process for a flash land, to be provided in a die for the forging of turbomachine vanes in accordance with specified parameters, where the vane has a blade and the blade is defined by plane sections in predetermined planes, and where the flash land and the flash gutter must be defined in accordance with the said plane so as to obtain plane sections of the blade and of the flash land, a process characterised by the fact that:

- one chooses at least three reference sections of the blade in reference planes corresponding to the root, middle and tip of the blade,
- in the said reference planes, one determines the length of the flash land and a shrinkage distance for the three reference sections,
- in the said predetermined planes, one constructs, by interpolation, the intermediate sections of the flash land and of the flash gutter from the said reference sections.

Preferably, before calculating the intermediate sections of the flash land and of its gutter, one effects different determinations of flash land parameters by varying the said parameters in the reference sections.

Again preferably, since the turbomachine vane has a leading edge and a trailing edge, the sections of the flash land and gutter corresponding to the leading and trailing edges are determined simultaneously.

The intermediate sections of the flash land and of its gutter can thus be calculated automatically for the most part, resulting in a considerable saving of time.

Advantageously, to determine the transverse intermediate sections of the flash land and of its gutter, one uses a polynomial interpolation.

And again preferably, following interpolation, one proceeds to the rectification of the flash gutters firstly to avoid the creation of surfaces that are undercut or more or less vertical and capable of making the die more fragile, and secondly to reduce height disparities at the tip of the vane.

The invention will be better understood with the aid of the following description of the process for determination of the flash land with reference to the appended plane, in which:

FIGS. 1 and 2 represent a perspective view of all of the plane sections Pi and the reference sections chosen from these plane sections for a turbomachine vane, and of sections of the flash land generated before rectification;

FIG. 3 is a geometrical figure showing the characteristic points for the definition of a leading or trailing edge section of a turbomachine vane and those of the connection of the flash land and of its gutter to the said edges, these points being used in the process according to the invention, FIG. 4 represents a perspective view of all of the sections of the part, of the flash land and of the corresponding unrectified turbomachine flash gutter, and rectified when necessary;

Figure 1:
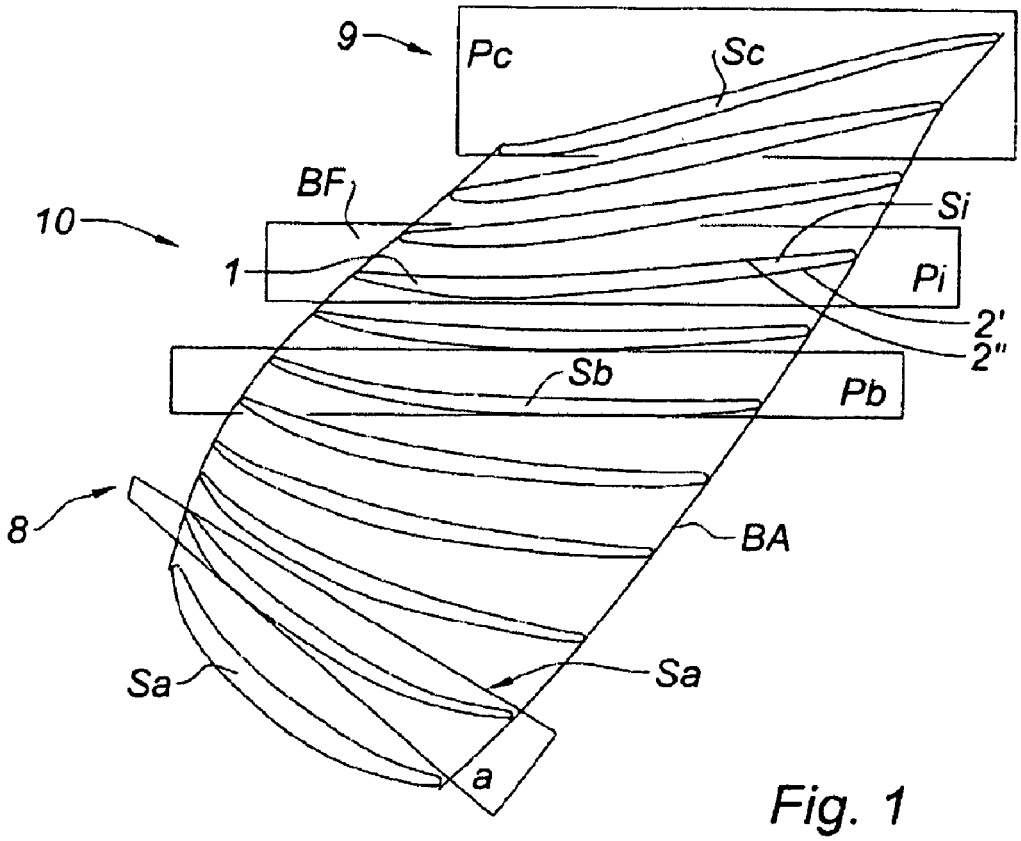

With reference to FIG. 1, a turbomachine vane blade 10 has two surfaces, lower and upper, between a leading edge BA and a trailing edge BF, on the one hand, and a blade tip 9 and a blade root 8, on the other. Between the lower and upper blade surfaces, the vane is composed of a material 1 that has been forged by means of a forging machine (not shown) of given power and acting on a press tool composed of two dies which will be returned to later.

The blade or airfoil section 10 is defined geometrically by plane sections Si located in predetermined planes Pi, at the intersection of these planes with the lower 2" and the upper 2' blade surfaces.

These sections are also those of the dies when they are in the position for forging of the part or of the vane and during the forging process. They will no longer be distinguished from each other in the remainder of the document.

During an initial stage, it is necessary to choose at least three planes 8, 10, 9 of reference Pa, Pb and Pc, providing three sections Sa, Sb, Sc. The three reference sections are used to determine the construction parameters of the flash land. This is what has been done at FIG. 2, where the three reference sections are sections S2, S6, S11 corresponding to the root, middle and tip of the blade.

In a second stage, called the verification stage, one geometrically constructs the flash lands 5 and their corresponding gutters 6 only for sections Sa, Sb and Sc, on the leading BA and trailing BF edges.

Figure 3:
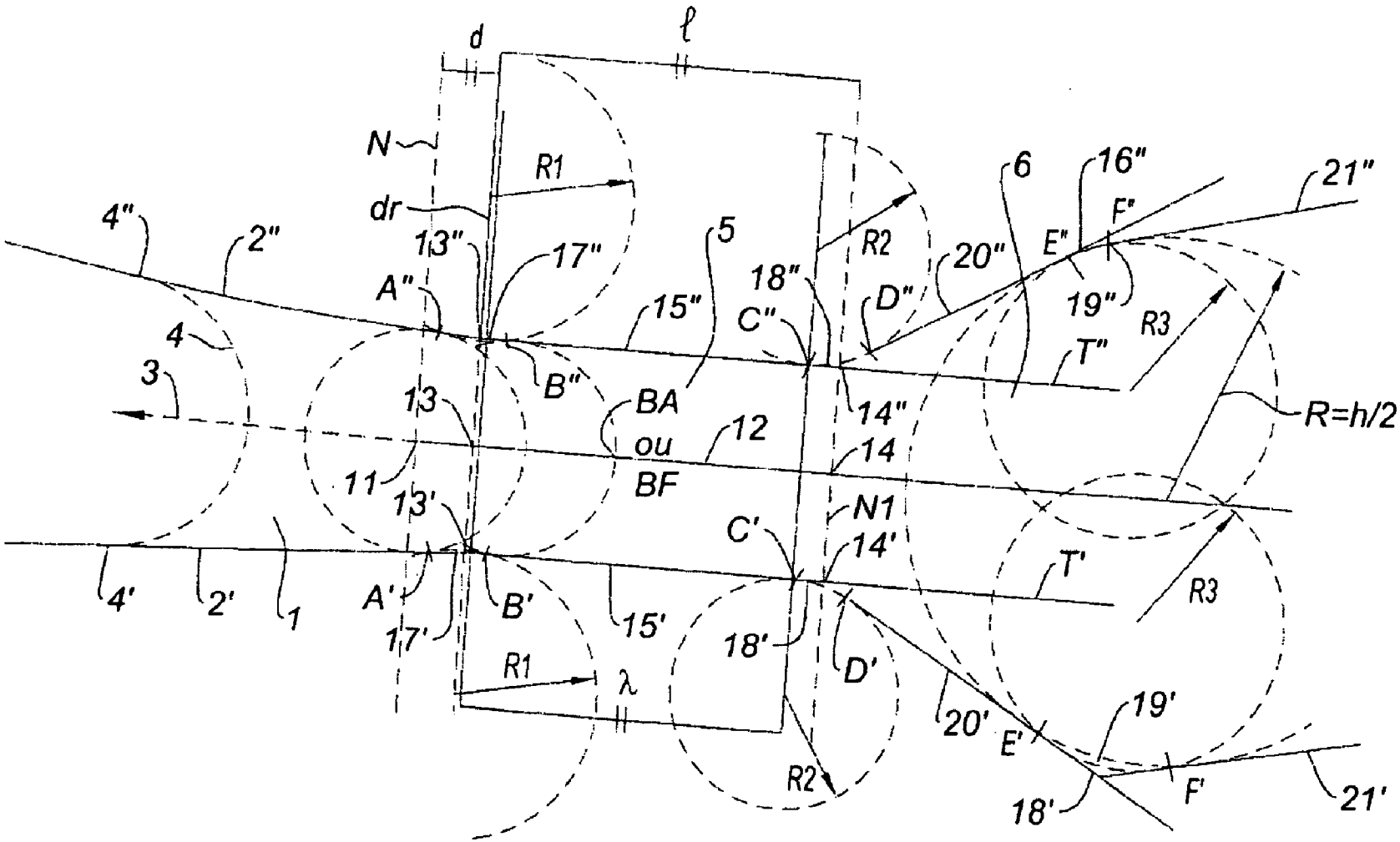

The construction is based upon the geometrical elements shown in FIG. 3, in which one recognises the intersections of the lower 2" and upper 2' blade surfaces with a reference plane Pj taken in the Pa, Pb and Pc set, and the trace on Pj of the leading BA or trailing BF edge.

The following additional elements are used here:

skeleton curve 3 all of the centre points of circles 4 simultaneously tangential to the upper (at 4') and lower (at 4") blade surfaces, one measuring point 11 obtained from the CAD (computer-aided design) definition of the part and used as a control or measuring point for the finished part.

These elements form part of the geometrical definition of the vane or of the dies, this being available on computer medium in a CAD format.

The following are defined in addition in the Pj plane, the tangent 12 to skeleton curve 3 at measuring point 11, and on this tangent, the following geometrical elements:

the point of shrinkage 13, located between the measuring point 11 and the leading edge BA, or the trailing edge BF depending on the case, at a shrinkage distance d from the measuring point 11, at a distance l from the shrinkage point 13, and in extension of the shrinkage point in relation to the measuring point, the gutter point 14, delimiting a segment of length l, the theoretical length of the flash land.

$\alpha$ is the opening-out angle of the flash gutter and R=h/2, the radius of the circle tangent to the flash gutter defining the length of the flash gutter and the height of the gutter between the dies. In general, the value of angle $\alpha$ is 60°.

The flash lands are defined by two dimensions, the length $\lambda$ and the thickness $\in$, these being related by the relation $\lambda/\in$. They are fixed on the basis of a complexity criterion related to the shape of the part and to the type of machine used. As an example, for a part in steel, forged at 1050° C. on a screw press, the actual length of the flash land should be:

$$\lambda=(\text{greatest width of the part})^{1/2}$$

For a part in titanium, forged at a temperature of 940° C., $\lambda$ is only half as big.

All of these elements are used to define the theoretical characteristic points of the section, known as the optimal points, of the flash land and of the corresponding flash gutter by the plane Pi:

the theoretical points 13' and 13", respectively intersections of the curves 2' (upper) and 2" (lower) with the straight line dr, normal to the skeleton curve and passing through point 13, removed by a certain distance, known as the shrinkage distance, from measuring point 11 of the leading or trailing edge of the blade the parallel lines T' (upper) and T" (lower) to tangent 12 passing respectively through 13' and 13"

the theoretical points 14' and 14", respectively intersections of the perpendicular N1 drawn from gutter point 14 to the tangent 12 with parallel lines T' and T", the theoretical points 16' and 16", respectively intersections of the half parallel straight lines 21' and 21" tangential to the circle of radius h/2 and the rays 20' and 20".

The segments 15' defined by the points 13'-14', 20' defined by the points 14'-16' and ray 21' on the one hand, and the segments 15" defined by the points 13"-14", 20" defined by the points 14"-16", and ray 21" on the other, determine the section, called the theoretical optimal, of the flash land 5 and of the corresponding flash gutter 6 in the plane Pj.

To obtain the characteristic geometrical points of the optimal section of the flash land and gutter actually used for the manufacture of the dies for the press tool, points identified by the letters A', B', C', OF, E', F' on the upper blade side and the letters A", B", C", OF', E", F" on the lower blade side, one introduces three connection radii R1, R2, R3 respectively, as shown in FIG. 3, and the coordinates of the above geometrical points. It is necessary that R1 should not be too large, so as not to touch the measuring point on the one hand, but sufficiently large so that there is no sharp edge between the flash land and the blade on the other. In other words, A' and A", in FIG. 3, are perpendicular to normal N. One finally obtains a useful flash land length of B'C' or B"C' equal to length $\lambda$ One proceeds in this manner for each reference plane Pa, Pb, Pc and one obtains global plane sections, so called because of joining-up the sections of the part, the flash land and the gutter in these reference planes, and therefore assembly of the reference sections Sa, Sb, Sc and of the optimal sections of the flash land and its gutter.

In a third stage, known as the choice stage, one determines parameters l and d, and then connections R1 and R2 in sections Pa, Pb, Pc. These variable parameters will be used to obtain the length $\lambda$ of the flash land that is best suited to the part.

When the parameters have been specified, one then passes to an interpolation stage, in order to obtain the optimal sections of the flash land and of its gutter in all planes Pi.

Figure 2:
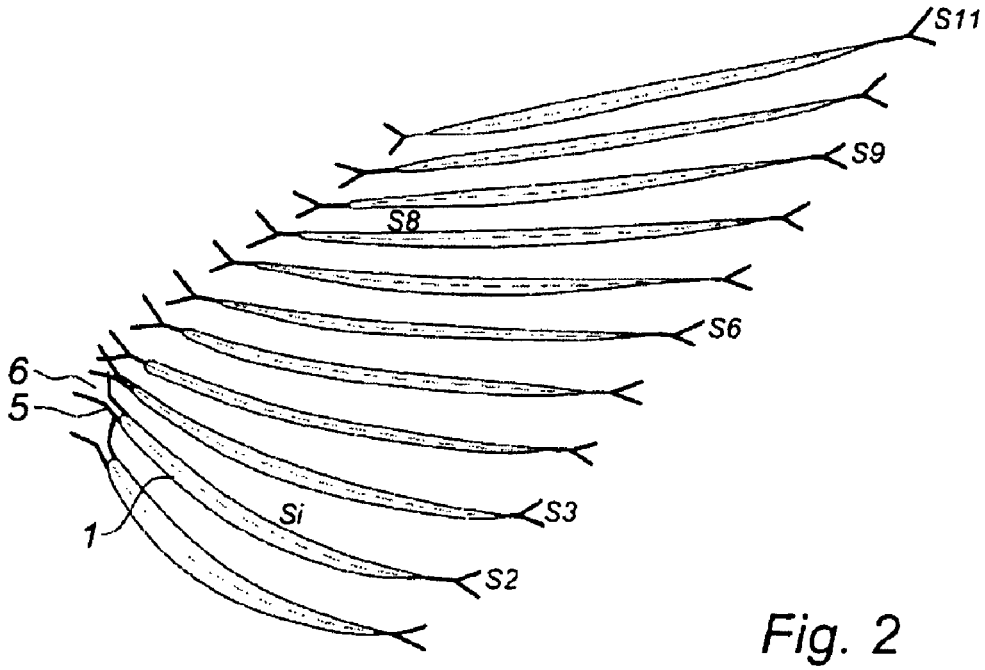
Figure 4:
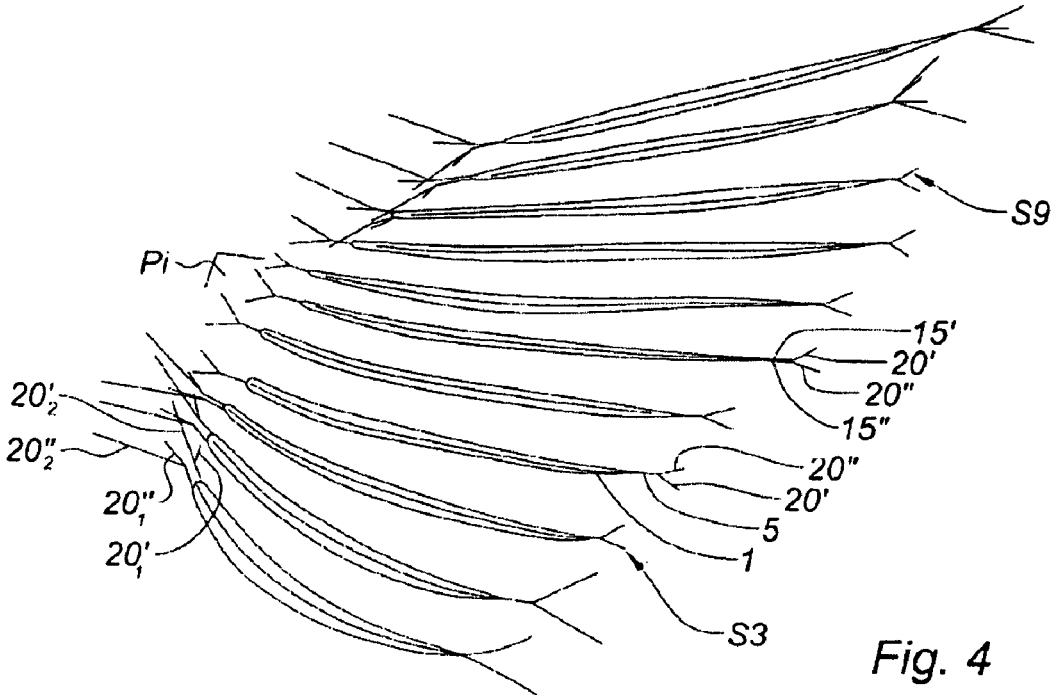

The automatic interpolation can be linear, quadratic, cubic, or generally polynomial, and one thus obtains the optimal sections 5 and 6 of FIG. 2 for all planes Pi. These optimal sections are also shown in FIG. 4 by the detail of segments 15', 15", 20', 20" of plane Pi.

The sections of the flash lands corresponding to the leading and trailing edges can be calculated simultaneously, but with different parameters, such as the theoretical length l of the flash land, the shrinkage distance defining its thickness $\in$, the height h, the angle $\alpha$, and so on.

Figure 5:
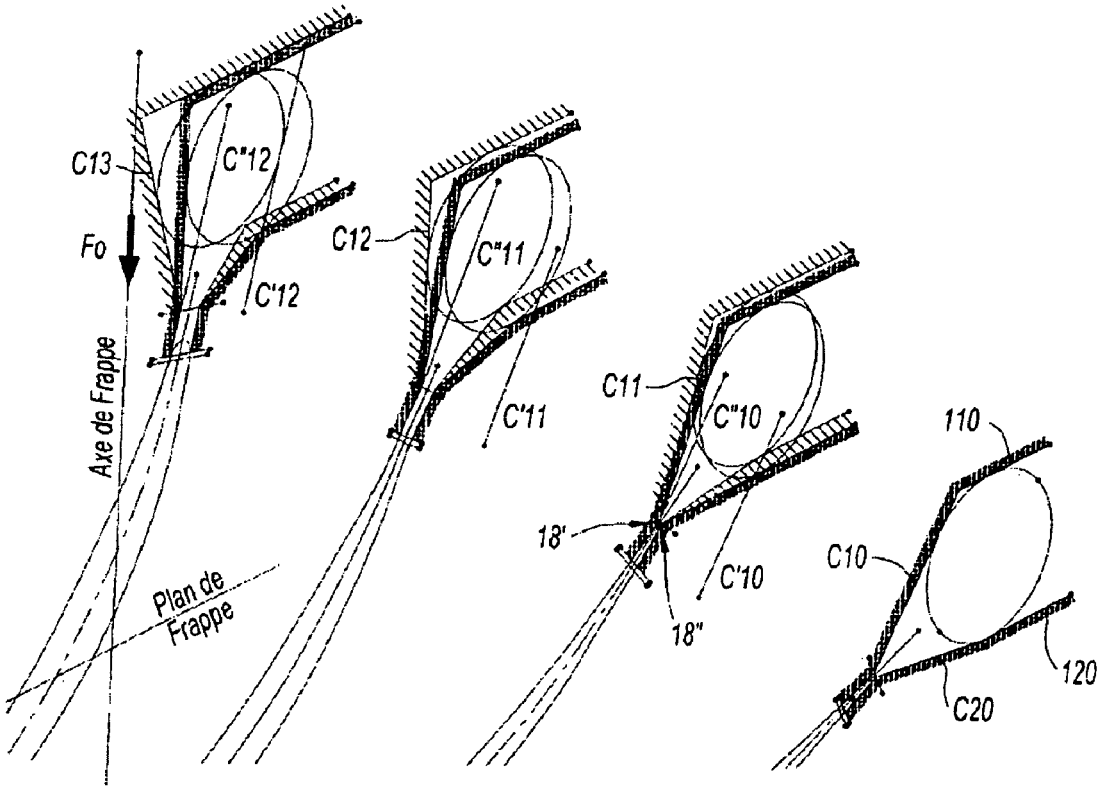
FIG. 5 represents a view of the press tool for forging a turbomachine vane, showing the strike axis, the strike plane and the angles of the flash gutter, unrectified and rectified, of a plane section of the flash land and of the corresponding flash gutter.

With reference to FIG. 5 however, for certain extreme values of i, close to the root of the vane for example, the result of the automatic interpolation may not be acceptable and may provide segments, such as C13, which are badly oriented in relation to the orientation of the strike Fo of the forging machine. In the example of the figure, the die is unable to force the material into the gutter angle.

It is during a fourth stage, called the rectification stage, that one rectifies the segments C11, C12 and C13, which are incorrectly oriented, according to segments C"12, C"11 and C"10.

In order to create the flash gutters, it is necessary to choose the reference sections BA and BF at the root and the tip of the vane. By choosing four reference sections, two at the leading edge BA, s3 at the root and s9 at the blade tip, and two at the trailing edge BF, s4 at the root and s8 at the blade tip, to rectify the orientation of the flash gutters, the process of construction allows us to obtain perfectly smooth surfaces.

Segments C10 and C20 of the reference section are projected onto the preceding or following section, represented by C'10, depending on whether one is located toward the root or the tip of the vane. By points 18' and 18" on FIG. 3, repeated on FIG. 5, one draws parallel lines to C'10 and C'20 respectively, and then one constructs firstly the bisecting lines between C11 and C"10 parallel to C'10 and passing through point 18, and secondly C21 and C"20 in the same manner through point 18". These segments, which are the new flash gutters and therefore the reference segments, are projected onto the preceding or following section, and so on.

A program designed for this purpose can be used to effect several tests in order to choose the reference sections that will give the best results. The rectification of the flash gutters is thus effected in a single operation.

Figure 6:
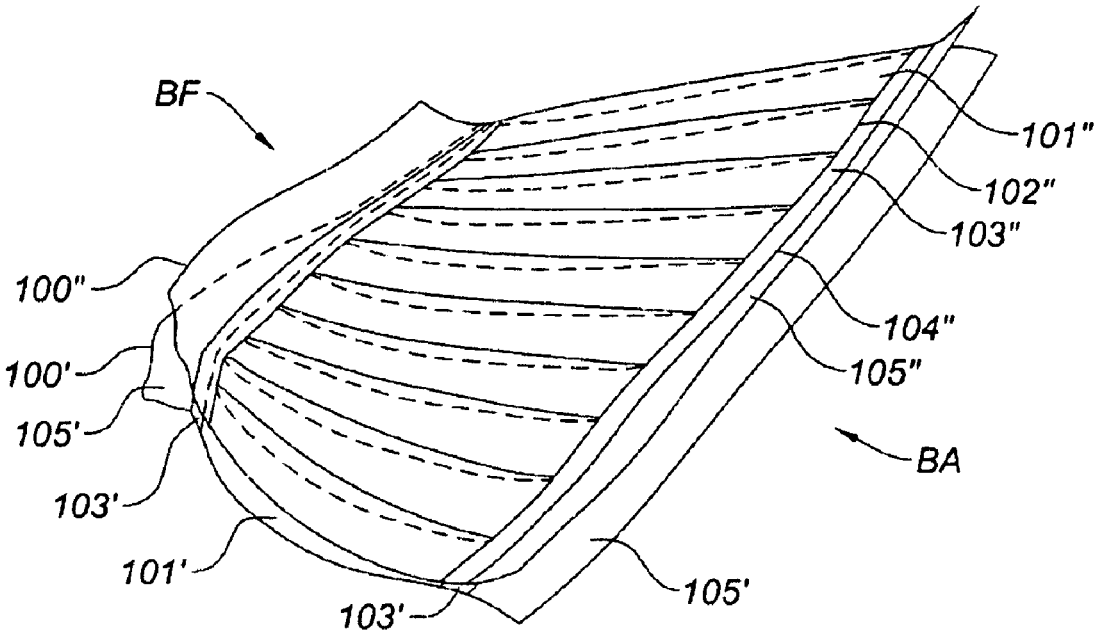
FIG. 6 represents a perspective view of the surfaces, flash land and flash gutter of a press die for forging a turbomachine vane, face to face, showing the result of the interpolation after application of the process of the invention.
Figure 7:
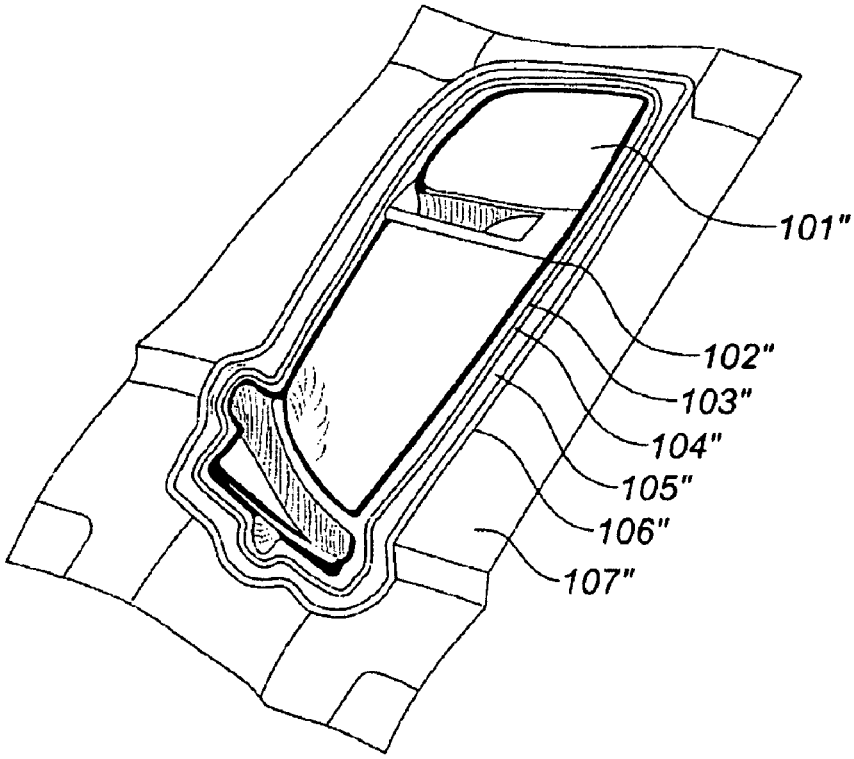
FIG. 7 represents a perspective view of the definitive surface of a die for the forging of a turbomachine vane.

After rectification the orientation of the flash gutters, one then proceeds to construction of the surfaces defining the theoretical flash lands and the associated gutters which will be used for creation of the press tool as shown in FIGS. 6 and 7.

In FIG. 6, the two contact surfaces of the dies for the forging of turbomachine vanes are shown face to face, and we are able to see the surfaces of dies 110 and 120:

101' for the blade,

102' for the radius R1 connection,

103' for the effective flash land,

104' for the radius R2 connection,

105' for the flash gutter,

106' for the radius R3 connection,

107' for the gutter of the tool, corresponding to ray 21'

The die 120 is represented here by the same corresponding elements, with the surfaces corresponding to X' being shown here as X".

FIG. 7 represents die 120 just by its elements already appearing in FIG. 6.

The invention claimed is:

1. A process for geometrical construction of a flash land, to be provided in a die for forging of a turbomachine vane, in accordance with determined parameters, where the vane includes a blade, the blade is defined by plane sections according to predetermined planes, and the flash land and a corresponding flash gutter of the flash land must be defined in accordance with said predetermined planes to obtain plane sections of the blade and of the flash land, said process comprising:

choosing at least three reference planes corresponding to a root, middle and tip of the blade, choosing, in said reference planes, at least three reference sections of the blade in reference planes corresponding to the root, middle and tip of the blade, determining, in said reference planes, a length of the flash land and a shrinkage distance for the three reference sections, and constructing by interpolation, in said predetermined planes, intermediate sections of the flash land and the corresponding flash gutter of the flash land from said reference sections.

2. The process according to claim 1, further comprising effecting different determinations of flash land parameters by varying said parameters in the reference sections before constructing the intermediate sections of the flash land and the corresponding gutter of the flash land.

3. The process according to claim 1, wherein the sections of the flash land and the corresponding flash gutter at leading and trailing edges are calculated simultaneously.

4. The process according to claim 1, wherein said constructing by interpolation the intermediate sections of the flash land and of the corresponding flash gutter of the flash land includes employing a polynomial interpolation technique.

5. The process according to claim 1, further comprising rectifying, after said constructing by interpolation, an orientation of the sections of the flash gutter in order to remove any substantially vertical undercuts or walls.

* * * * *